US009549262B2

(12) United States Patent
Wang et al.

(10) Patent No.: US 9,549,262 B2
(45) Date of Patent: Jan. 17, 2017

(54) MINIATURE ELECTROACOUSTIC TRANSDUCER AND ASSEMBLING METHOD THEREOF

(75) Inventors: Ze Wang, Shandong (CN); Lianshan Ge, Shandong (CN); Chunfa Liu, Shandong (CN)

(73) Assignee: GOERTEK INC. (CN)

( * ) Notice: Subject to any disclaimer, the term of this patent is extended or adjusted under 35 U.S.C. 154(b) by 0 days.

(21) Appl. No.: 14/379,835

(22) PCT Filed: Feb. 22, 2012

(86) PCT No.: PCT/CN2012/071461

§ 371 (c)(1),
(2), (4) Date: Sep. 4, 2014

(87) PCT Pub. No.: WO2013/123652

PCT Pub. Date: Aug. 29, 2013

(65) Prior Publication Data

US 2015/0016659 A1 Jan. 15, 2015

(30) Foreign Application Priority Data

Feb. 20, 2012 (CN) ..... 2012 1 0037945

(51) Int. Cl.
*H04R 11/02* (2006.01)
*H04R 9/02* (2006.01)
(Continued)

(52) U.S. Cl.
CPC ..... *H04R 9/025* (2013.01); *H04R 9/046* (2013.01); *H04R 9/06* (2013.01); *H04R 31/00* (2013.01);
(Continued)

(58) Field of Classification Search
CPC ..... H04R 9/025; H04R 9/045; H04R 2209/04; H04R 2400/11; H04R 2499/11; H04R 2201/02; H04R 2209/024
See application file for complete search history.

(56) References Cited

U.S. PATENT DOCUMENTS 7,346,182 B2 * 3/2008 Sato ..... H04R 9/06 381/396
8,180,096 B2 * 5/2012 Sano ..... H04R 9/025 181/161
(Continued)

FOREIGN PATENT DOCUMENTS

CN 201383870 Y 1/2010
CN 201789621 U 4/2011
(Continued)

OTHER PUBLICATIONS

Chinese Office Action for application No. 201210037945.1 dated Jan. 14, 2015.
(Continued)

*Primary Examiner* — Joseph J Nguyen
*Assistant Examiner* — Ryan Robinson
(74) *Attorney, Agent, or Firm* — Hauptman Ham, LLP

(57) ABSTRACT

A miniature electroacoustic transducer includes: a metal shell, having the shape of a barrel with one open end; a vibrating system, including a vibrating diaphragm and a voice coil; and a magnetic circuit system, including a concentrating flux plate, a magnet and a magnetic yoke that are sequentially combined together. The magnetic circuit system is formed with a magnetic gap corresponding to the voice coil; the vibrating system and the magnetic circuit system are fixedly installed in the barrel-shaped shell; the components in the structure are further modularized, maximizing the magnet under the same product dimension and effectively improving the product sensitivity. An assembling method of the electroacoustic transducer includes: a. providing a barrel-shaped metal shell with one open end; b. putting a pre-assembled vibrating system into the shell; c. putting a pre-assembled magnetic circuit system into the
(Continued)

shell; and d. fixedly assembling the shell with the magnetic yoke.

20 Claims, 9 Drawing Sheets

(51) Int. Cl.

| | |
|---|---|
| ***H04R 9/06*** | (2006.01) |
| ***H04R 31/00*** | (2006.01) |
| ***H04R 9/04*** | (2006.01) |
| *H04R 1/02* | (2006.01) |
| *H04R 1/06* | (2006.01) |

(52) U.S. Cl.
CPC ..... *H04R 31/006* (2013.01); *H04R 1/021* (2013.01); *H04R 1/06* (2013.01); *H04R 2209/022* (2013.01); *H04R 2209/024* (2013.01); *H04R 2499/11* (2013.01); *Y10T 29/49005* (2015.01)

(56) References Cited

U.S. PATENT DOCUMENTS 8,643,236 B2 * 2/2014 Li ..... H04M 1/03 310/25
2007/0237352 A1 * 10/2007 Andersen ..... H04R 9/022 381/414
2008/0317276 A1 * 12/2008 Sorensen ..... H04R 9/063 381/401
2013/0156237 A1 * 6/2013 Kim ..... H04R 9/06 381/191
2013/0202149 A1 * 8/2013 Yoon ..... H04R 9/02 381/433

FOREIGN PATENT DOCUMENTS

CN 102256196 A 11/2011
CN 202488628 U 10/2012
CN 202488629 U 10/2012
CN 202488687 U 10/2012
KR WO 2011027995 A2 * 3/2011 ..... H04R 9/06

OTHER PUBLICATIONS

Chinese Office Action for Chinese patent application No. 201210037945.1 mailed on Apr. 30, 2014.
International Search Report mailed Nov. 29, 2012 for PCT/CN2012/071461.
Written Opinion for PCT/CN2012/071461 dated Nov. 29, 2012.

* cited by examiner

MINIATURE ELECTROACOUSTIC TRANSDUCER AND ASSEMBLING METHOD THEREOF

CROSS REFERENCE TO RELATED APPLICATION

This application claims the priority of Chinese Patent Application No. 201210037945.1, filed on Feb. 20, 2012 in the Chinese Patent and Trademark Office.

Further, this application is the National Phase application of International Application No. PCT/CN2012/071461 filed on Feb. 22, 2012, which is incorporated herein by reference in its entirety.

TECHNICAL FIELD

The present invention relates to the electroacoustic field, particularly to a miniature electroacoustic transducer and an assembling method of the same.

BACKGROUND ART

With the rapid development of portable electronic products such as cellphone and laptop, a large number of electroacoustic transducers particularly miniature electroacoustic transducers are widely used. The conventional miniature electroacoustic transducer comprises a vibrating system, a magnetic circuit system and a shell for fixing the vibrating system and the magnetic circuit system, and a front cover is arranged on the shell, wherein the shell is typically a plastic shell, the magnetic circuit system is fixed by adhesive or injection molding, and the vibrating system is fixed by a series of tooling fixtures.

In this type of conventional electroacoustic transducer, its components and parts are relatively separate from each other which causes the design of the product complicated, and meanwhile the size of the magnet is in constraints due to the injection-molded shell which may have adverse effects to the improvements of sensitivity; and further, a lot of tooling fixtures and complicated assembling process are required in the assembling of the product, which is not good to cost-efficiency.

Thus, there is a need for further improving the structure and assembling procedures of the conventional miniature electroacoustic transducer to avoid the above defects.

SUMMARY OF THE INVENTION

Technical Problem

The technical problem sought to be solved by the present invention is to provide a miniature electroacoustic transducer which is capable of further modularizing internal components of the miniature electroacoustic transducer, simplifying product design, maximizing the size of the magnet under the same product dimension and effectively improving the product sensitivity; meanwhile, to provide an assembling method of the miniature electroacoustic transducer, by which the modularized components can be assembled in a modularized way, thereby simplifying the product assembling process and reducing the production cost.

Technical Solution

In order to achieve the above objectives, the miniature electroacoustic transducer provided by the present invention comprises: a metal shell, having the shape of a barrel with one open end; a vibrating system, comprising a vibrating diaphragm and a voice coil; and a magnetic circuit system, comprising a concentrating flux plate, a magnet and a magnetic yoke that are sequentially combined together, wherein the magnetic circuit system is formed with a magnetic gap corresponding to the voice coil, and the vibrating system and the magnetic circuit system are fixedly installed in the barrel-shaped shell.

As an improvement, an opening for sound output is arranged at the bottom of the shell.

As an improvement, a first support is arranged between the vibrating system and the bottom of the shell.

As an improvement, a second support is arranged between the vibrating system and the magnetic circuit system.

As an improvement, a positioning step for fixing the magnetic circuit system correspondingly is arranged on the second support.

As an improvement, a transition trench is arranged at the bottom of the shell proximate to the sidewall.

As an improvement, the shell and the concentrating flux plate are fixed by the seaming of the sidewall of the shell.

As an improvement, the vibrating system further comprises a centering pad through which the voice coil is electrically connected with an external circuit of the miniature electroacoustic transducer.

The assembling method of the miniature electroacoustic transducer provided by the invention comprises the following steps:

(a) providing the barrel-shaped metal shell with one open end;

(b) placing a pre-assembled vibrating system into the shell to position the vibrating system corresponding to the opening for sound output of the shell;

(c) placing a pre-assembled magnetic circuit system into the shell;

(d) fixedly assembling the shell with the magnetic yoke.

As an improvement, a first support is arranged between the vibrating system and the bottom of the shell; and the vibrating system is assembled with the first support integrally together before the step (b).

As an improvement, the vibrating diaphragm comprises a spherical top portion in the center and a loop-bending portion on the edge, a centering pad is arranged between the vibrating diaphragm and the voice coil, and the assembling of the vibrating system comprises the following steps:

(a) assembling the spherical top portion with the centering pad, and assembling the loop-bending portion with the first support;

(b) assembling the spherical top portion which is assembled with the centering pad with the loop-bending portion which is assembled with the first support together.

As an improvement, a second support is arranged between the vibrating system and the magnetic circuit system; and the magnetic circuit system is assembled with the second support integrally together before the step (c).

As an improvement, the magnetic circuit system is of dual magnetic circuit structure comprising an external concentrating flux plate and an external magnet, and an internal concentrating flux plate and an internal magnet which are sequentially assembled with the magnetic yoke respectively; and the magnetic circuit system is assembled by the following steps:

(a) assembling the internal concentrating flux plate, the internal magnet and the magnetic yoke sequentially, and fixedly assembling the external concentrating flux plate with the second support;

(b) assembling the external concentrating flux plate and the second support which have been assembled together, and the external magnet, with the internal concentrating flux plate, the internal magnet and the magnetic yoke, which have been assembled together, sequentially.

Advantageous Effects of the Invention

With the above technical solution, compared with conventional structures, the components in the structure of the miniature electroacoustic transducer provided by the invention are further modularized, thereby simplifying the product design, maximizing the size of the magnet under the same product dimension and effectively improving the product sensitivity. Meanwhile, with the assembling method of the miniature electroacoustic transducer provided by the present invention, the modularized components can be assembled in a modularized way, thereby simplifying the product assembling process and reducing the production cost.

BRIEF DESCRIPTION OF THE DRAWINGS

The present invention is described in connection with the accompanying drawings and embodiments.

DETAILED DESCRIPTION OF THE EMBODIMENTS

In the below, the present invention is described in detail in connection with the accompanying drawings.

Figure 1:
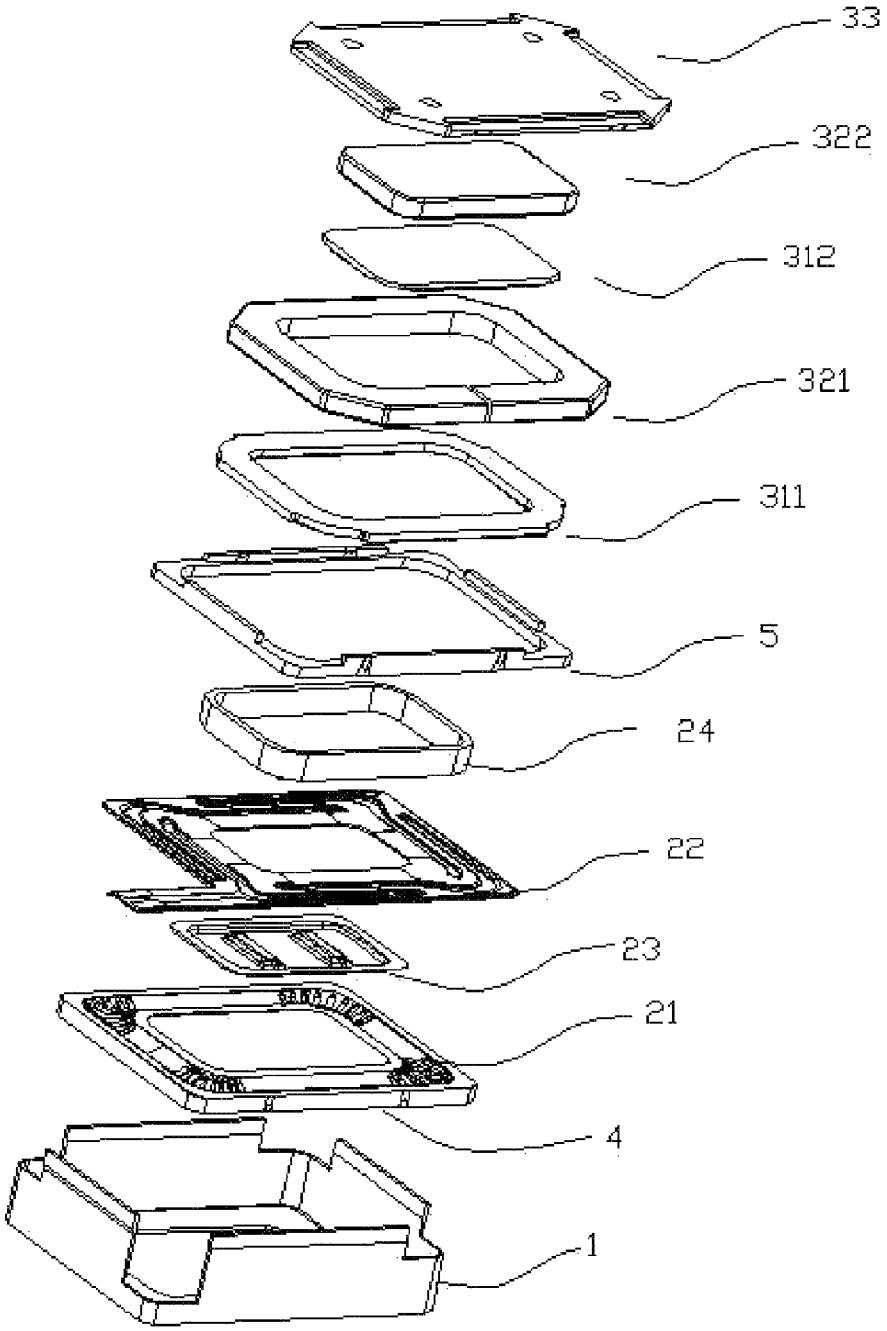
FIG. 1 is an exploded schematic view illustrating the miniature electroacoustic transducer according to the embodiments of the present invention.
Figure 2:
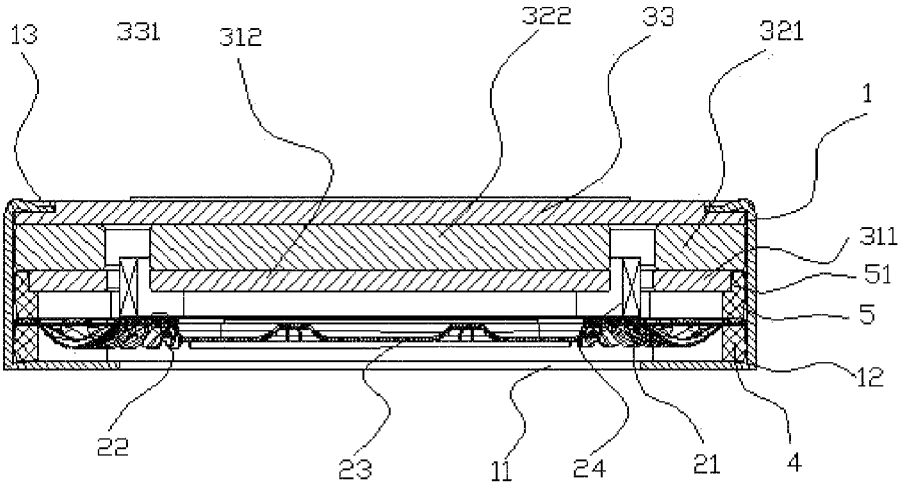
FIG. 2 is a schematic cross-section view illustrating the miniature electroacoustic transducer according to the embodiments of the present invention.
Figure 3:
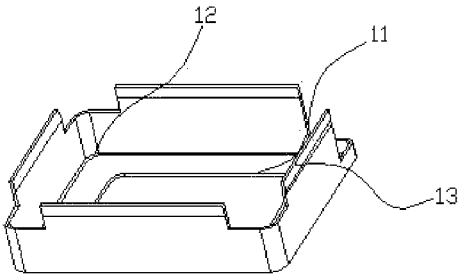
FIG. 3 is a perspective view illustrating the shell of the miniature electroacoustic transducer according to the embodiments of the present invention.
Figure 4:
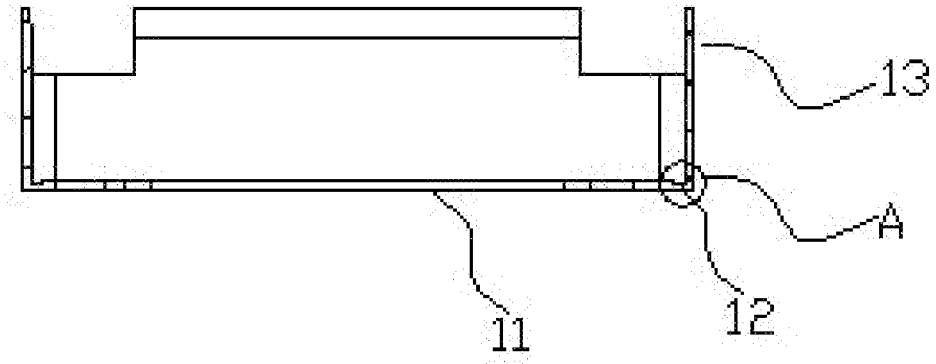
FIG. 4 is a schematic cross-section view illustrating the shell of the miniature electroacoustic transducer according to the embodiments of the present invention.
Figure 5:
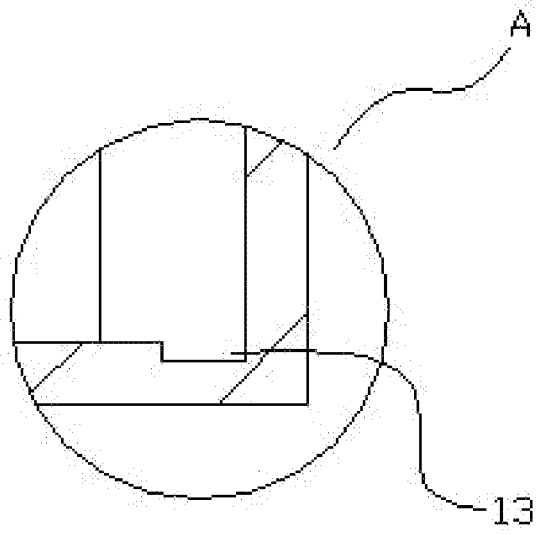
FIG. 5 is a schematic partial enlarged view of the part A in FIG. 4.

As illustrated in FIGS. 1 to 5, a miniature electroacoustic transducer comprises: a barrel-shaped metal shell 1; a vibrating system, comprising a vibrating diaphragm and a voice coil 24; and a magnetic circuit system forming a magnetic gap corresponding to the voice coil 24, the magnetic circuit system acting on the voice coil 24 to enable the vibrating system to vibrate and sound when the voice coil 24 is applied with an alternating current signal, the magnetic circuit system comprising a concentrating flux plate, a magnet and a magnetic yoke 33 that are sequentially combined together; and the vibrating system and the magnetic circuit system are fixedly installed in the barrel-shaped shell 1.

With such a design where the external assembly structure of the miniature electroacoustic transducer is formed by the barrel-shaped shell, and the vibrating system and the magnetic circuit system are installed in the shell, the components in the structure of the miniature electroacoustic transducer provided by the invention are further modularized, thereby simplifying the product design while the overall thickness of the shell can be reduced with the structure of the metal shell, thus maximizing the size of the magnet under the same product dimension and effectively improving the product sensitivity.

In the present embodiment, the metal shell 1 is fixedly assembled with the magnetic yoke 33 so as to fixedly house the miniature electroacoustic transducer. In the present embodiment, the magnetic circuit system is preferably of a dual magnetic circuit structure comprising an internal concentrating flux plate 312 and an internal magnet 322, and an external concentrating flux plate 311 and an external magnet 321 which are sequentially assembled with the magnetic yoke 33 respectively. The dual magnetic circuit system can provide greater driving force. And the magnetic circuit structure of the magnet may also be only one magnet of an internal or external magnetic circuit structure based on actual demand.

In the present embodiment, in order to achieve better acoustics, preferably, an opening 11 for sound output is arranged at the bottom of the metal shell 1, the vibration system is provided so as to correspond to the opening 11; the shell 1 and the magnetic yoke 33 are fixedly assembled together by laser weld, glue bonding or seaming, and the shell 1 in the present embodiment is fixedly assembled with the magnetic yoke 33 by seaming of the side wall, which is a simpler way of assembly; vibrating space can be provided for the diaphragm between the vibrating system and the bottom of the shell 1 by providing independent supports or making parts of the shell 1 protruding outward based on the characteristics of different product structures, it is preferable to provide a first support 4 between the vibrating system and the shell 1 by which first support 4 the vibrating system and the bottom of the shell 1 are spaced apart from each other so as to provide enough vibrating space for the diaphragm;

additionally, a second support 5 is preferably arranged between the magnetic circuit system and the vibrating system, which enables precise location of the vibrating system and the magnetic circuit system; with the provision of the independent supports, product design can be simplified, and the assembling process is simple; the first support 4 and the second support 5 can be insulating material such as plastic material, in order to improve the assembly strength of the miniature electroacoustic transducer according to the embodiments of the present invention, a positioning step 51 corresponding to the assembly of the magnetic circuit system is further arranged on the second support 5, which makes the overall structure firmer.

Additionally, a transition trench 12 is arranged in the region proximate to the sidewall of the shell 1 at the bottom of the shell 1, to avoid the formation of approximate fillet at the corner region between the sidewall and the bottom of the shell 1 when bending, which may affect the overall assembly height of the miniature electroacoustic transducer.

The voice coil 24 and the miniature electroacoustic transducer may be electrically connected to external circuits of the miniature electroacoustic transducer by flying leads or built-in conductive elements. In the present embodiment, a centering pad 22 is arranged between the diaphragm and the voice coil 24, the centering pad 22 may be a flexible circuit board or a conducting sheet, and the voice coil 24 is electrically connected to the outside of the miniature electroacoustic transducer through the centering pad 22. With such an improvement, it is convenient for stabilizing the electrical connection of the voice coil 24, and the miniature electroacoustic transducer is prevented from eccentric vibrating by the addition of the centering pad 22.

Figure 6:
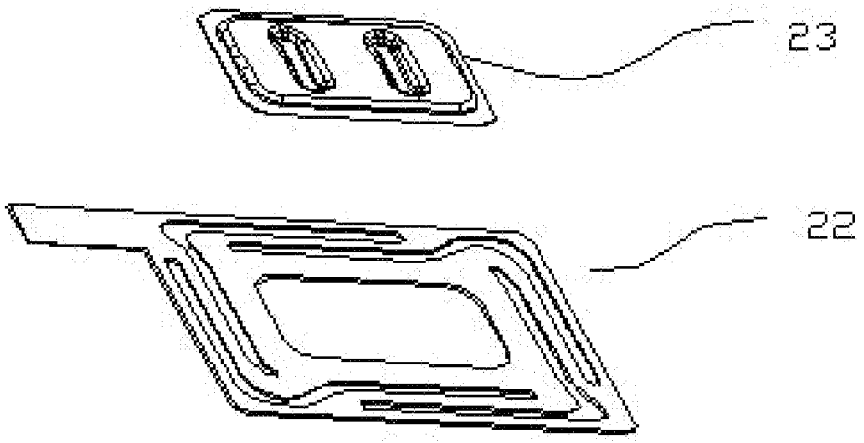
FIG. 6 is a schematic assembly view illustrating the spherical top portion and the centering pad of the miniature electroacoustic transducer according to the embodiments of the present invention.
Figure 7:
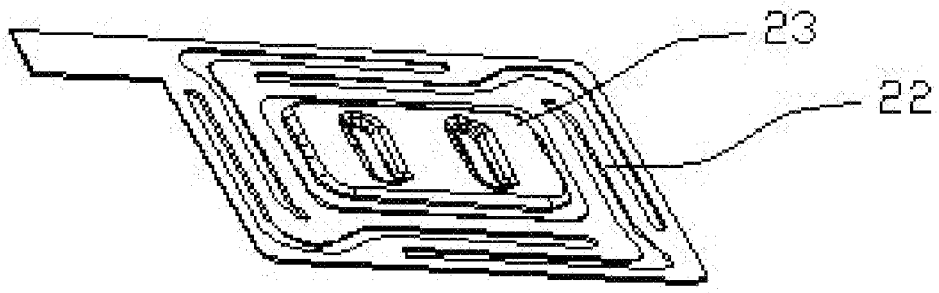
FIG. 7 is a schematic view illustrating the spherical top portion and the centering pad in FIG. 6 after being assembled.
Figure 8:
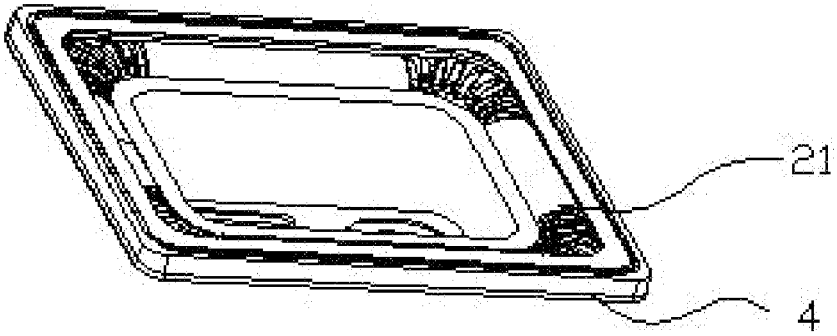
FIG. 8 is a schematic assembly view illustrating the loop-bending portion and the first support of the miniature electroacoustic transducer according to the embodiments of the present invention.
Figure 9:
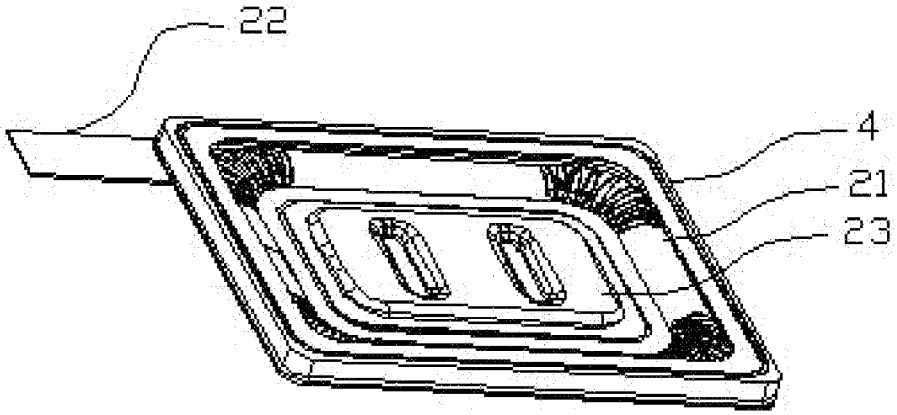
FIG. 9 is a schematic view illustrating the loop-bending portion and the first support in FIG. 8 after being assembled.
Figure 10:
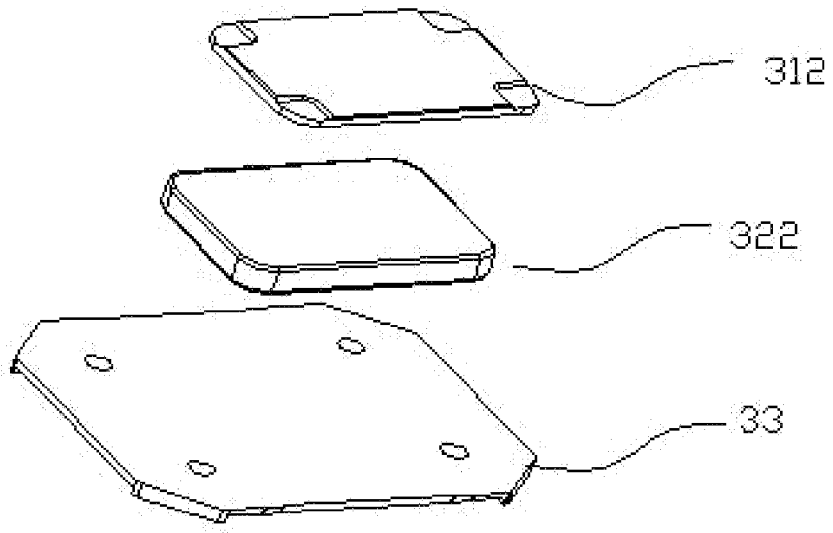
FIG. 10 is a schematic assembly view illustrating the internal concentrating flux plate, the internal magnet and the magnetic yoke according to the embodiments of the present invention.
Figure 11:
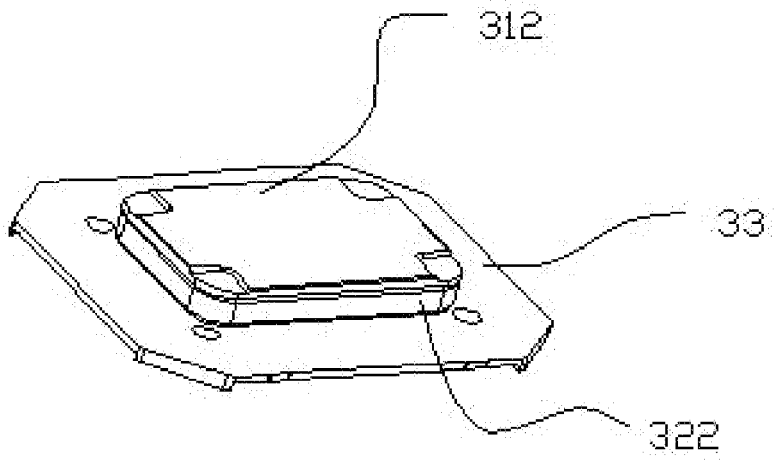
FIG. 11 is a schematic view illustrating the internal concentrating flux plate, the internal magnet and the magnetic yoke in FIG. 10 after being assembled.
Figure 12:
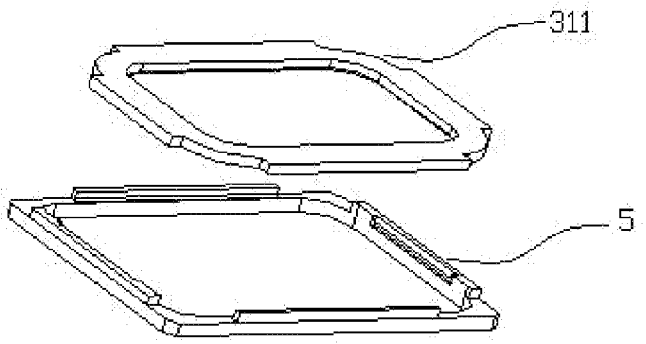
FIG. 12 is a schematic assembly view illustrating the external concentrating flux plate and the second support of the miniature electroacoustic transducer according to the embodiments of the present invention.
Figure 13:
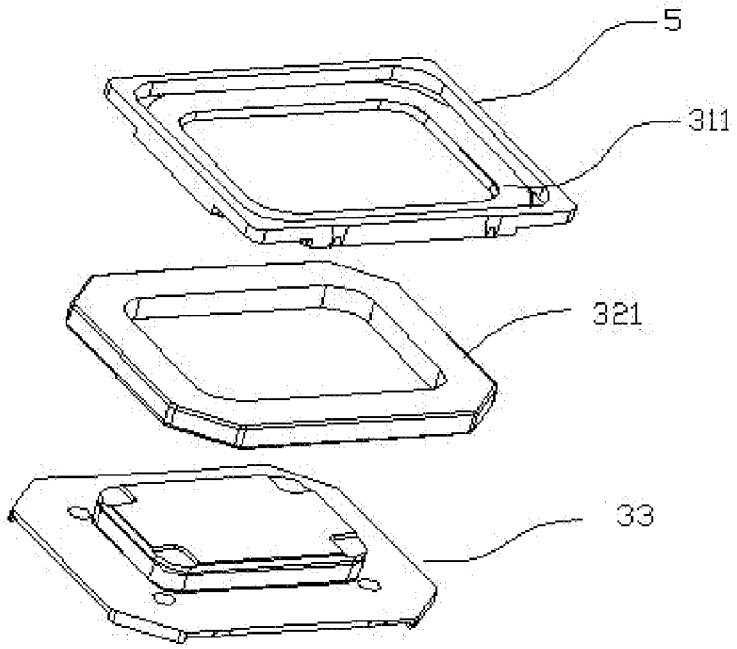
FIG. 13 is a schematic assembly view illustrating the structures in FIG. 10 and FIG. 12 assembled with the external magnet.
Figure 14:
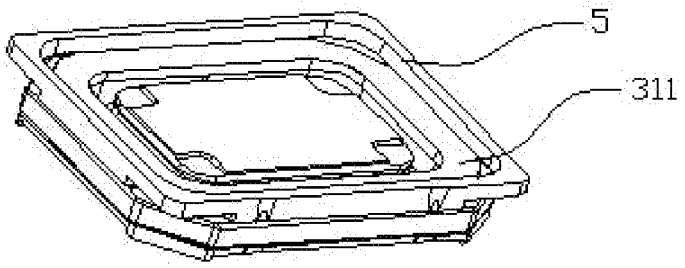
FIG. 14 is a schematic view illustrating the structures in FIG. 13 after being assembled.
Figure 15:
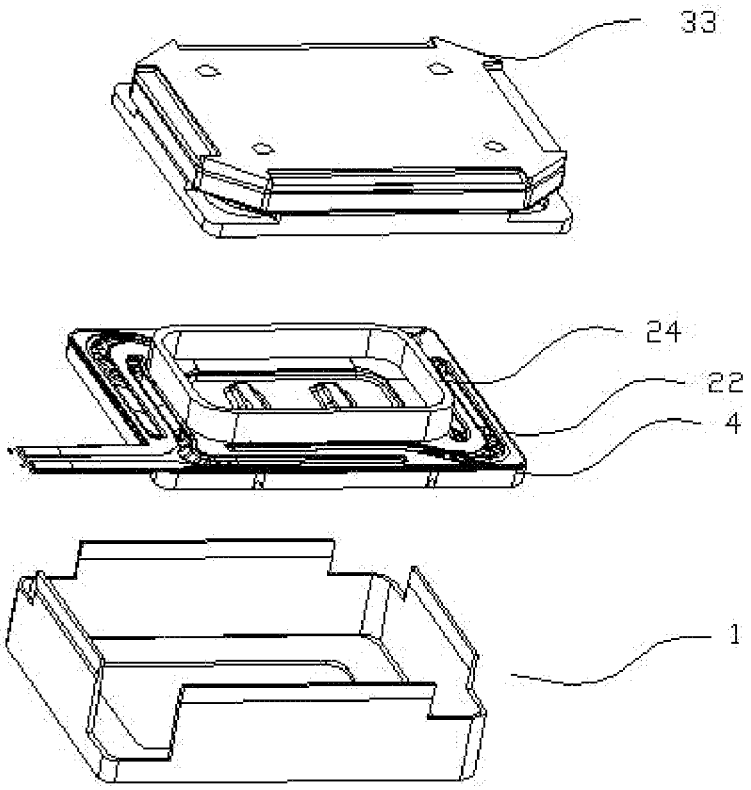
FIG. 15 is a schematic assembly view illustrating the miniature electroacoustic transducer according to the embodiments of the present invention.
Figure 16:
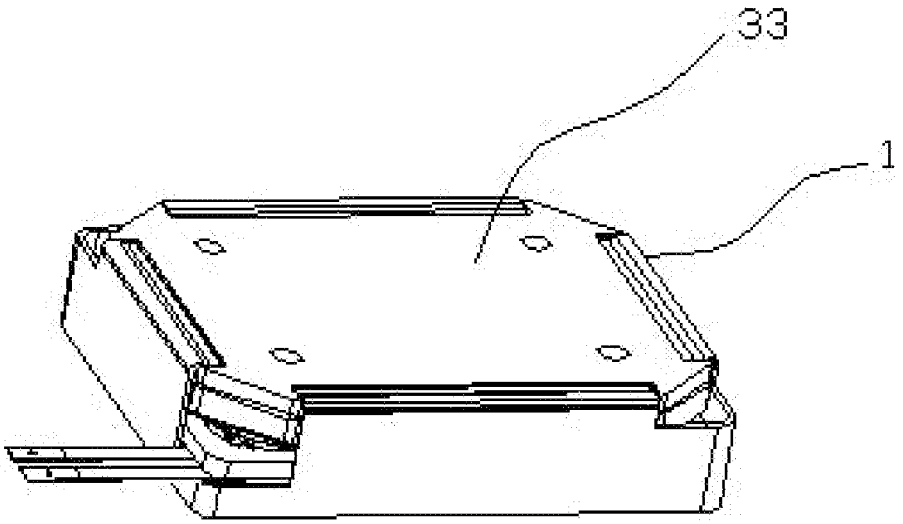
FIG. 16 is a schematic view illustrating the structures in FIG. 15 after being assembled.

FIG. 6 to FIG. 16 are detailed description of the assembly diagram of the product according to the present embodiment. The overall structure of the miniature electroacoustic transducer in the present innovation can be assembled through the following assembling method of:

(a) providing a barrel-shaped metal shell 1 with one open end;

(b) placing a pre-assembled vibrating system into the shell 1;

(c) placing a pre-assembled magnetic circuit system into the shell 1; and (d) fixedly assembling the shell 1 with the magnetic yoke 33.

With the assembling method of the miniature electroacoustic transducer, the vibrating system and the magnetic circuit system can be pre-assembled separately. When the overall structure of the miniature electroacoustic transducer is being assembled, the components of the miniature electroacoustic transducer are assembled in a modularized way, thereby simplifying the product assembling process and reducing the production cost.

In the assembling process for the vibrating system, it is preferable to pre-assemble the magnetic circuit system and the first support 4 integrally before the step (b), which may further facilitate modularized assembly of the product; more specifically, using the following assembling method of: (a) assembling a spherical top portion 23 with the centering pad 22, and a loop-bending portion 21 with the first support 4; (b) assembling the spherical top portion 23 assembled with the centering pad 22 with the loop-bending portion 21 assembled with the first support 4 together. With such a design improvement, the first support 4 may have the function of fixing the loop-bending portion 21. Meanwhile, the assembling method is simpler, and the assembly of the vibration system is simplified. While the assembling sequence for the voice coil 24 in the vibration system can be adjusted based on actual demands, it is preferable to pre-assemble the spherical top portion 23 with the centering pad 22 in the present embodiment.

In the assembling process for the magnetic circuit system, it is preferable to pre-assemble the magnetic circuit system with the second support 5 together before the step (c). By pre-assembling the magnetic circuit system with the second support 5, the components of the miniature electroacoustic transducer are further assembled in a modularized way, thereby simplifying the assembling process. More specifically, the improved magnetic circuit system is assembled as follows: (a) assembling the internal concentrating flux plate 312, the internal magnet 322 and the magnetic yoke 33 sequentially, and fixedly assembling the external concentrating flux plate 311 with the second support 5; (b) assembling the external concentrating flux plate 311 and the second support 5 which have been assembled together, and the external magnet 321, with the internal concentrating flux plate 312, the internal magnet 322 and the magnetic yoke 33 which have been assembled together, sequentially. With the assembling method for the magnetic circuit system, the assembly of the magnetic circuit system is further simplified, and the production cost is reduced.

Additionally, while the miniature electroacoustic transducer in accordance with the embodiments of the present invention has a square shape, it can also be of circular shape, track-like shape or other appropriate shape. In the present embodiment, electrical connection with the centering pad may also be replaced by incorporating a circuit board on the magnetic yoke, and the shell may also be assembled with the seaming of the circuit board. The dual magnetic circuit structure of the magnetic circuit system is only one preferable solution of the invention, and the magnetic circuit system may also be of an internal or external magnetic circuit system with a magnet located inside or outside the voice coil. Various modifications and variations, which fall into the scope of the present invention, can be made by those skilled in the art based on the above embodiments under the above teachings of the present invention. It is understood by those skilled in the art that the above specific description are just provided for better understanding of the present invention, and the scope of the present invention is defined by the claims and their equivalents.

The invention claimed is:

1. A miniature electroacoustic transducer, comprising:

a shell comprising a metal part, bent at a transition region, defining a bottom of the shell and a sidewall of the shell, the metal part having a first thickness between a first inner surface of the bottom of the shell and an outer surface of the bottom of shell and a second thickness, less than the first thickness, between a second inner surface of the bottom of the shell and the outer surface of the bottom of the shell;

a vibrating system, comprising a vibrating diaphragm and a voice coil; and a magnetic circuit system, comprising a concentrating flux plate, a magnet and a magnetic yoke, wherein the magnetic circuit system has a magnetic gap corresponding to the voice coil, the vibrating system and the magnetic circuit system are fixedly installed in the shell, the second inner surface of the bottom of the shell is closer to the sidewall of the shell than the first inner surface of the bottom of the shell, the first inner surface of the bottom of the shell is connected to the second inner surface of the bottom of the shell by a trench sidewall, and the trench sidewall, the second inner surface of the bottom of the shell and the sidewall of the bottom of the shell define a transition trench proximate to the sidewall of the shell.

2. The miniature electroacoustic transducer according to claim 1, wherein the bottom of the shell has an opening defined therein for sound output.

3. The miniature electroacoustic transducer according to claim 1, further comprising:

a first support between the vibrating system and the bottom of the shell.

4. The miniature electroacoustic transducer according to claim 3, further comprising:

a second support between the vibrating system and the magnetic circuit system.

5. The miniature electroacoustic transducer according to claim 4, further comprising:

a positioning step for fixing the magnetic circuit system on the second support.

6. The miniature electroacoustic transducer according to claim 1, wherein the shell and the concentrating flux plate are fixedly combined together by a seaming of the sidewall of the shell.

7. The miniature electroacoustic transducer according to claim 1, wherein the vibrating system further comprises a centering pad through which the voice coil is electrically connected with an external circuit of the miniature electroacoustic transducer.

8. A method of assembling a miniature electroacoustic transducer, the method comprising:

placing a vibrating system comprising a vibrating diaphragm and a voice coil into a shell comprising a metal part, bent at a transition region, defining a bottom of the shell and a sidewall of the shell, the metal part having a first thickness between a first inner surface of the bottom of the shell and an outer surface of the bottom of shell and a second thickness, less than the first thickness, between a second inner surface of the bottom of the shell and the outer surface of the bottom of the shell;

placing a magnetic circuit system comprising a concentrating flux plate, a magnet and a magnetic yoke into the shell; and fixedly assembling the shell with the magnetic yoke, wherein the metal part is bent such that the second inner surface of the bottom of the shell is closer to the sidewall of the shell than the first inner surface of the bottom of the shell, the first inner surface of the bottom of the shell is connected to the second inner surface of the bottom of the shell by a trench sidewall, and the trench sidewall, the second inner surface of the bottom of the shell and the sidewall of the bottom of the shell define a transition trench proximate to the sidewall of the shell.

9. The method of assembling the miniature electroacoustic transducer according to claim 8, further comprising:

coupling a first support with the vibrating system before the vibrating system is placed into the shell such that the first support is arranged between the vibrating system and the bottom of the shell after the vibrating system is is placed into the shell.

10. The method of assembling the miniature electroacoustic transducer according to claim 9, further comprising:

assembling the vibrating diaphragm by:

coupling a spherical top portion with a centering pad;

coupling a loop-bending portion with the first support; and coupling the spherical top portion with the loop-bending portion, wherein the centering pad is arranged on a voice coil side of the vibrating diaphragm and the voice coil.

11. The method of assembling the miniature electroacoustic transducer according to claim 10, wherein the magnetic circuit system is assembled before the magnetic system is placed into the shell.

12. The method of assembling the miniature electroacoustic transducer according to claim 11, further comprising:

coupling a second support with the magnetic circuit system before the magnetic circuit system is placed into the shell such that the second support is arranged between the vibrating system and the magnetic circuit system.

13. The method of assembling the miniature electroacoustic transducer according to claim 12, further comprising:

assembling the magnetic circuit system by:

coupling an external concentrating flux plate with the second support;

coupling an internal concentrating flux plate and an internal magnet with the magnetic yoke; and coupling the previously coupled external concentrating flux plate and second support with an external magnet, and with the previously coupled internal concentrating flux plate, internal magnet and magnetic yoke.

14. The miniature electroacoustic transducer according to claim 1, wherein the shell is barrel-shaped.

15. The miniature electroacoustic transducer according to claim 1, wherein the sidewall of the shell at least partially defines an opening opposite the bottom of the shell.

16. The miniature electroacoustic transducer according to claim 1, wherein the first inner surface of the bottom of the shell is parallel to the second inner surface of the bottom of the shell.

17. The miniature electroacoustic transducer according to claim 1, wherein the sidewall has a third thickness between an inner surface of the sidewall of the shell and an outer surface of the sidewall of the shell, and the third thickness is equal to the first thickness.

18. The miniature electroacoustic transducer according to claim 1, wherein the first inner surface of the bottom of the shell has a length in a first direction perpendicular to the sidewall of the shell, and the second inner surface of the shell has a second length in the first direction less than the first length.

19. The miniature transducer according to claim 1, wherein the second inner surface of the bottom of the shell extends from the trench sidewall to the sidewall of the shell, and the trench sidewall is substantially orthogonal to the second inner surface of the bottom of the shell.

20. The method of assembling miniature electroacoustic transducer according to claim 8, further comprising:

bending the metal part at the transition region to cause the first inner surface of the bottom of the shell to be perpendicular to the sidewall of the shell.

* * * * *